US010189277B2

(12) United States Patent
Schiestl

(10) Patent No.: US 10,189,277 B2
(45) Date of Patent: Jan. 29, 2019

(54) DEVICE AND METHOD FOR PRETREATING AND PRINTING TEXTILE SURFACES

(71) Applicant: Aeoon Technologies GmbH, Kramsach (AT)

(72) Inventor: Angelo Schiestl, Langkampfen (AT)

(73) Assignee: Aeoon Technologies GmbH, Kramsach (AT)

( * ) Notice: Subject to any disclaimer, the term of this patent is extended or adjusted under 35 U.S.C. 154(b) by 0 days.

(21) Appl. No.: 15/746,171

(22) PCT Filed: Jul. 7, 2016

(86) PCT No.: PCT/EP2016/066061
§ 371 (c)(1),
(2) Date: Jan. 19, 2018

(87) PCT Pub. No.: WO2017/012879
PCT Pub. Date: Jan. 26, 2017

(65) Prior Publication Data

US 2018/0207954 A1 Jul. 26, 2018

(30) Foreign Application Priority Data

Jul. 20, 2015 (EP) ..... 15177439

(51) Int. Cl.
*B41J 3/407* (2006.01)
*B41J 11/00* (2006.01)
(Continued)

(52) U.S. Cl.
CPC ..... *B41J 3/4078* (2013.01); *B41J 11/0015* (2013.01); *B41J 11/06* (2013.01);
(Continued)

(58) Field of Classification Search
CPC combination set(s) only.
See application file for complete search history.

(56) References Cited

U.S. PATENT DOCUMENTS

2015/0165789 A1* 6/2015 Watanabe ..... B41J 11/36 347/102
2015/0273866 A1* 10/2015 Sakai ..... B41J 3/4078 347/21
2015/0314615 A1* 11/2015 Humet ..... B41J 2/2103 347/9

FOREIGN PATENT DOCUMENTS

EP 2 481 593 A2 8/2012
JP 2002 155464 A 5/2002

OTHER PUBLICATIONS

International Search Report and Written Opinion dated Jan. 26, 2017 for PCT/EP2016/066061.

* cited by examiner

*Primary Examiner* — Jason S Uhlenhake
(74) *Attorney, Agent, or Firm* — Dinsmore & Shohl LLP

(57) ABSTRACT

The invention relates to an apparatus and a method for pretreating and printing textile surfaces. For this purpose, at least one pallet (22) for accommodating and retaining a textile article (20) to be printed on a printing face, a pretreatment device (40) which allows the textile article to be pretreated, prior to it being printed, by applying a pretreatment fluid to the textile article in a pretreatment area, a printing device (60) comprising at least one printhead (61) that allows a printed image to be printed onto the textile article in the pretreatment area, a moving device (23) which allows the at least one pallet to he displaced relative to the pretreatment device and the printing device, and a programmable control device (31) which allows the printing device, the pretreatment device and/or the moving device to be controlled, are provided. An identification device (30) which can identify the textile article and is connected to the programmable control device is provided in front of the pretreatment device, and depending on the identified textile
(Continued)

article, the pretreatment area can be applied individually to a subarea of the printing dace of the textile article.

14 Claims, 1 Drawing Sheet

(51) Int. Cl.

| | |
|---|---|
| ***B41M 5/00*** | (2006.01) |
| ***B41J 11/06*** | (2006.01) |
| ***D06P 5/00*** | (2006.01) |
| ***D06P 5/30*** | (2006.01) |

(52) U.S. Cl.
CPC ..... *B41M 5/0047* (2013.01); *D06P 5/002* (2013.01); *D06P 5/30* (2013.01)

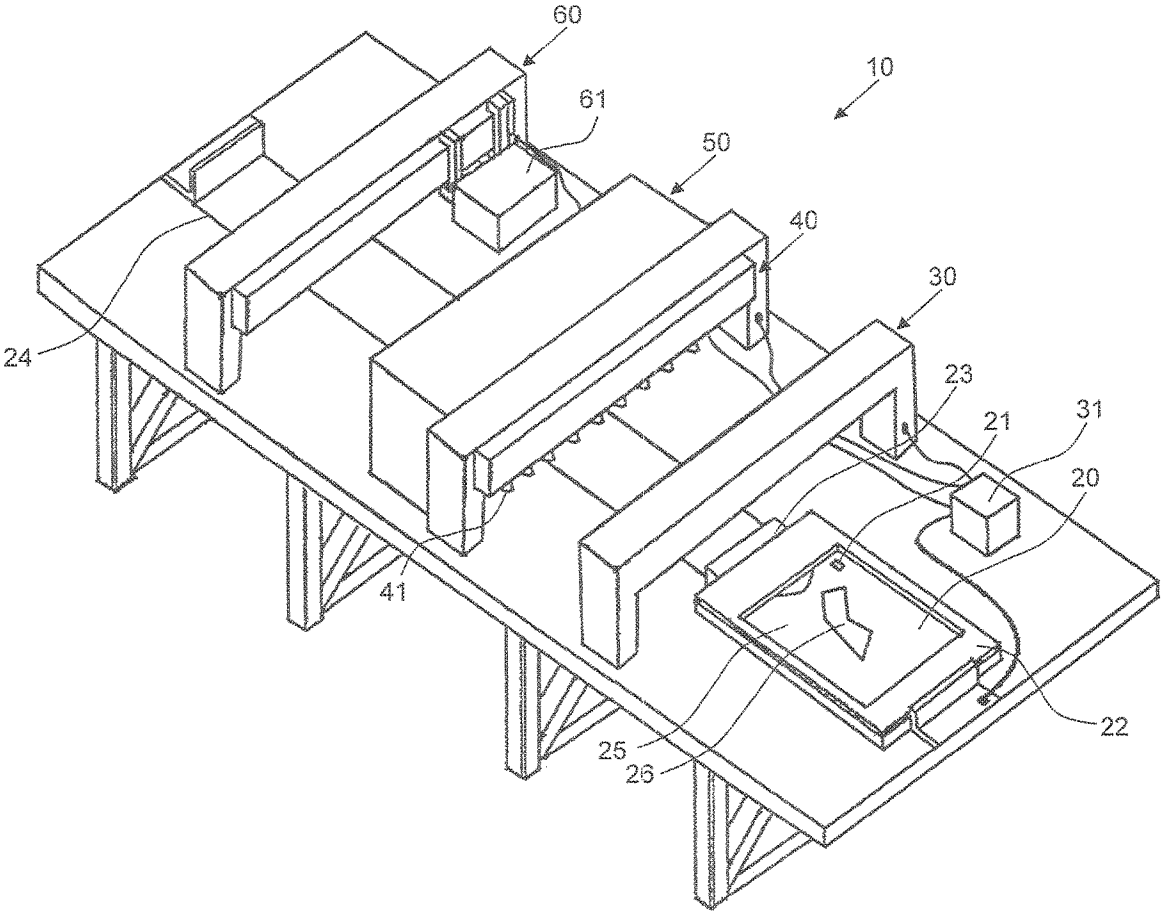
10
60
61
50
40
30
23
21
31
20
22
24
41
25
26

DEVICE AND METHOD FOR PRETREATING AND PRINTING TEXTILE SURFACES

The invention relates to a device for pretreating and printing textile surfaces in accordance with the preamble of claim 1.

A device of such type has at least one pallet for accommodating and holding a textile to be printed, wherein, for the purpose of printing, the textile is provided on a printing face, a pretreatment means, by means of which the textile can be pretreated prior to printing, wherein on the textile a pretreatment fluid is applied in a pretreatment area, a printing means having at least one print head, by means of which the textile can be printed with the printed image in the pretreatment area, a movement means, by means of which the at least one pallet can be moved relative to the pretreatment means and the printing means, and a programmable control means, by means of which the printing means, the pretreatment means and/or the movement means can be controlled.

Furthermore, the invention relates to a method for pretreating and printing textile surfaces in accordance with the preamble of claim 9.

In such a method a textile is pretreated by means of a pretreatment means prior to printing, wherein a pretreatment fluid is applied in a pretreatment area, a printing means, having at least one print head, prints a printed image onto the textile in the pretreatment area, a programmable control means controls the printing means and/or the pretreatment means.

A generic device and a corresponding method for pretreating and printing textile surfaces is known from EP 2 481 593 A1 for example. In this device and the corresponding method a wetting composition is provided, by means of which a textile surface to be printed is pretreated in order that in a second step a printed image is applied onto the pretreated textile surface. In this case, the pretreatment liquid is applied in a planar manner on a printing face of the textile to be printed.

The chemicals of a wetting composition are, on the one hand, supposed to prevent colorant droplets applied onto the textile by a printing means from bleeding in the fibers of the textile due to capillary forces or other physical and/or chemical processes which can lead to a blurring of the printed image. Thus, a first function of the wetting composition can reside in ensuring the stability of the printed image on the textile surface.

On the other hand, the employed chemicals of the pretreatment fluid are supposed to have a positive influence on the bonding capacity of the colorant droplets applied onto the textile to the fibers of the fabric and thereby enhance and accelerate the bonding of the printed image to the textile surface at the position provided on the textile.

For instance through reaction of the pretreatment fluid with the fabric or with droplets of the applied printing ink and/or through subsequent chemical or thermal treatment of the printing ink and the textile wetted with the pretreatment fluid the previously outlined properties of the pretreatment fluid can be brought about and/or enhanced.

Excessive pretreatment fluid on the textile pretreated in a planar manner, which does not make contact with printing ink, remains in this case unused on the textile for example or, in a subsequent washing process, is led into the environment as a waste product.

The invention is based on the object to provide a device for pretreating and printing a garment and a corresponding method which permit the use of pretreatment fluid in a particularly ecological and consumable-sparing manner.

In accordance with the invention the object is achieved on the one hand by a device having the features of claim 1 and on the other hand by a method having the features of claim 9.

Advantageous embodiments are stated in the dependent claims, the description and the FIGURE.

The device according to the invention for pretreating and printing textile surfaces is characterized in that a detection means is provided, by means of which the textile can be detected, and in that the detection means is connected to the programmable control means, wherein, depending on the detected textile, the pretreatment area can be applied individually onto a partial area of the printing face of the textile.

Furthermore, the method according to the invention for pretreating and printing a textile surface is characterized in that the textile is detected by a detection means and in that the programmable control means, which is connected to the detection means, determines the printing area on the detected textile and in that depending on the detected textile the pretreatment means applies the pretreatment area individually onto a partial area of the printing face of the textile.

A fundamental idea of the invention resides in the fact that a device for pretreating and printing with a pretreatment means and a corresponding method are provided, by means of which those areas of a textile are selectively pretreated with a pretreatment fluid that are subsequently printed with printing ink. Thus, even in the case of complex printed images intermediate spaces between motifs and uncolored areas of a printed image can be excluded from pretreatment. Compared to a planar application this can enable a considerably more efficient use of pretreatment fluid.

According to a further development of the invention it is preferred that the pretreatment means has at least one nozzle, by means of which the pretreatment fluid can be applied onto the textile, and in that the at least one nozzle can be controlled by means of the programmable control means. The pretreatment fluid can be provided in a storage tank that is connected via a line system to the pretreatment means. The at least one nozzle can be designed such that the flow rate of pretreatment fluid through the at least one nozzle of the pretreatment means can be adjusted by a programmable control means.

In particular, this can enable an interruption of the fluid flow from the at least one nozzle in order to provide an untreated area on a textile.

An expedient further development of the invention can reside in the fact that the pretreatment means is designed over the entire width of the textile. This can have an advantageous effect on the pretreatment speed because in this way a lateral movement of the pretreatment means along the width of the textile is not necessary to wet the pretreatment area on the textile with pretreatment fluid. A pretreatment means provided in a stationary manner in a direction transverse to the movement direction of the textile can be subject to less wear than comparable pretreatment means that are movable in a direction transverse to the movement direction.

A particularly preferred further development of the invention can reside in the fact that the pretreatment means has a plurality of nozzles, wherein the nozzles can be controlled individually by the programmable control means. In particular, the plurality of nozzles can be provided on the pretreatment means over the entire width of the textile. Nozzles which can be closed at least temporarily and independently of each other by the programmable control means during the application of pretreatment fluid can enable in a particularly advantageous manner the provision of an individual pretreatment area on at least one partial area of the printing face of the textile in that at least one area of the printing face can be excluded from pretreatment. For this, the textile on the pallet can be passed by the movement means underneath the pretreatment means, in which case the individual nozzles of the pretreatment means can be opened individually so that they only allow the discharge of pretreatment fluid if a partial area of the individual pretreatment area has been delivered to the corresponding nozzle or nozzles. The pretreatment means can also be movable transversally with respect to the textile which can allow for an especially quick and even pretreatment of the textile. The control means also controls the movement of the pallet which is a carrier means for the textile. The movement means can have a conveyor chain or a conveyor belt.

An expedient further development of the invention can reside in the fact that the pretreatment means is provided at an entrance area of a drying means which is in particular designed as a continuous dryer. Thus, immediately after application the pretreatment fluid can be freed from a proportion of solvent and/or undergo thermal treatment. In this case, it is especially preferred that the drying means is designed over the entire width of the textile which can enable an even treatment of the textile.

According to a further development of the invention it is preferred that through the detection means a position of the textile on the pallet can be determined and in that through the programmable control means the pretreatment area can be applied depending on the position of the textile. Hence, the textile can be provided in any chosen horizontal alignment on the pallet, in which case the programmable control means can control the pretreatment means on the basis of the information of the detection means in order to enable an individual wetting of the pretreatment area with pretreatment fluid and align the pretreatment area on the textile in such a manner that the printed image shows the desired orientation on the textile. For this purpose, the detection means can determine the alignment e.g. on the basis of a marking or the textile structure.

According to a further development it is preferred that the programmable control means is designed to receive a clearly defined print job sent by a user and containing printing and image data, to identify the area to be printed on the textile by means of the detection means and to print a corresponding printed image onto the textile by means of the printing means. The programmable control means can assign the textile by means of the detection means to the clearly defined print job containing printing and image data and provide a corresponding printed image with an orientation on the textile according to order. By means of the programmable control means the printing means can in particular be controlled to provide the printed image in the previously applied pretreatment area on the textile.

According to a further development of the invention it is especially expedient that a digital printing means having at least one printing nozzle prints the printed image onto the pretreated textile which is located on the pallet and that the printing means is controlled by the programmable control means, wherein the printed image is printed individually onto the detected textile. By means of digital printing technology a printed image can be provided on a textile in a particularly precise manner. For this purpose, the printing nozzle can be arranged in a laterally movable manner at least along the width of the textile provided. The programmable control means can transmit information regarding an envisaged printed image to be provided on the textile to the printing means for a printing process. The printed image to be provided on the textile as well as further information required by the programmable control means for controlling the device can be transmitted by a user via an input terminal or a remote data line to the programmable control means. It may be expedient that the programmable control means is designed such that information relating to several print jobs can even be stored in the programmable control means by several users. The programmable control means can therefore also be used as a database for print jobs that have already been carried out, for those to be retrieved and performed again as well as for future print jobs. Alternatively, provision can also be made for a separate database for storing print jobs which is connected to the programmable control means.

A preferred further development of the method according to the invention can reside in the fact that the textile is provided with a marking which is designed to indicate an association of the textile with a print job clearly defined beforehand and containing printing and image data. The marking can be provided in the form of a print on the textile, wherein the marking can contain e.g. all information required for carrying out the print job or constitutes a reference to information stored in the programmable control means for example. In particular, the marking can be provided in the form of a bar code, QR-code, an RFID-marking or another type of visual or sensor-recordable embodiment.

A preferred further development of the method according to the invention can reside in the fact that a detection means detects a marking on the textile and that the programmable control means assigns the marking to a print job clearly defined beforehand and containing printing and image data. In this connection it may be advantageous for the detection means to be suitably designed for the markings employed.

Expediently, a further development of the invention can reside in the fact that the detection means has a readout means and/or a sensor means, by means of which the marking on the textile can be read out by the programmable control means. The readout means can for example be designed such that it detects the marking provided on the textile and transmits this to the programmable control means. In particular, concerned here can be a laser scanner. The sensor means can in particular be an optical sensor means which is designed to detect specific properties of the textile such as position, type of textile, textile cut or a marking. More particularly, the sensors can be at least one camera. Based on the information recorded by the readout means and/or the sensor means the programmable control means can control the device pursuant to the invention as planned according to a clearly defined and stored print job.

According to a further development of the invention it is especially expedient that by means of the detection means the programmable control means ascertains the position of the marking on the textile and transmits this information to the pretreatment means, that the pretreatment means, based on the transmitted information and according to the print job clearly defined beforehand, applies the pretreatment area as intended. In this, the pretreatment means can be controlled by the programmable control means in order that, according to the print job, the pretreatment area, which is designed as at least one partial area of the printing face of the detected textile, is wetted individually with pretreatment fluid.

According to a further development of the method pursuant to the invention it is preferred that the programmable control means receives a print job containing printing and image data that were sent by a user and that by means of the printing means the textile is printed with a corresponding printed image. The programmable control means can receive and process the print job. On a suitable textile, which has a marking corresponding to the print job in particular and is provided in the device, the printed image can be printed according to the print job.

The invention will be explained further hereinafter by way of the accompanying drawing, wherein shows:

FIG. 1 a schematic illustration of the device according to the invention for pretreating and printing textile surfaces.

FIG. 1 shows a device 10 for printing textile surfaces. A textile 20 to be printed is provided with a printing face 25 on a pallet 22, which is in a set-up position, in which the pallet 22 can be loaded with the textile 20. By means of the movement means 23 the textile 20 on the pallet 22 is supported in a movable manner along a guide rail 24 and can be delivered successively to the individual means of the device 10. Starting from the set-up position, in a movement direction of the pallet 22 a detection means 30 is initially arranged, by means of which the textile 20, more particularly a marking 21 on the textile, can be detected by a programmable control means 31. The programmable control means 31 is connected to all means of the device 10. The information determined by the detection means 30 with regard to the textile 20 can be assigned by means of the programmable control means 31 to a clearly defined print job. By means of an input terminal on the device 10 or via a long-distance communication connection the print job can be transmitted by the user to the programmable control means 31. The printing and image data thus transmitted are converted by the programmable control means 31 into a control of the individual means of the device 10 according to orders.

In the movement direction of the pallet 22, starting from the set-up position of the pallet 22, a pretreatment means 40 designed in a direction transverse to the movement direction of the pallet 22 is provided behind the detection means 30. The pallet 22 can be passed underneath the pretreatment means 40, with a pretreatment fluid being applied onto the textile 20. The pretreatment means 40 has a plurality of nozzles 41 that are designed along the pretreatment means 40 and extend on this over the entire width of the textile 20 on the pallet 22 in the direction transverse to the movement direction of the pallet 22. Through individual actuation, in particular by opening and closing the nozzles 41 during application of the pretreatment fluid onto the textile, the programmable control means 31 controls the pretreatment means 40 in order to apply an individual pretreatment area 26 onto the textile 20, in which the printed image can be provided according to order. The said pretreatment area is illustrated schematically on the textile 20 in FIG. 1. In this, those areas of the printing face of the textile can in particular be excluded from pretreatment which are not printed with a printed image. Control of the pretreatment means 40 takes place according to the information of the print job concerning the textile to be printed which was transmitted by the detection means 30 to the programmable control means 31 or is stored in the programmable control means 31.

In the movement direction of the pallet 22, after the pretreatment means 40 a dryer 50 is arranged which extends in an elongate manner along the guide rail 24 and by means of which the applied pretreatment fluid on the textile 20 can be dried and/or treated thermally.

In the movement direction of the pallet 22, after the dryer 50 the printing means 60 is arranged which has at least one print head 61 that is supported in an alterable manner in a direction transverse to the movement direction of the pallet. The print head, which can be a digital ink jet print head in particular, is movable over the entire width of the textile 20, thereby even enabling printing in a marginal area of the textile 20. The printing means 60 with the print head 61 is controlled by the programmable control means 31 in order to provide the printed image according to order in the pretreated area on the textile. For removal the textile can be moved back into a first set-up position in front of the detection means 30. In doing so, the pallet with the printed textile passes once more at least the dryer 50 which, in a second drying step, can dry or thermally treat the printing ink applied to the textile to ensure a particularly good bonding of the printing ink to the textile surface.

The invention claimed is:

1. Device for pretreating and printing textile surfaces having at least one pallet for accommodating and holding a textile to be printed, wherein, for the purpose of printing, the textile is provided on a printing face, a pretreatment means, by means of which the textile can be pretreated prior to printing, wherein on the textile a pretreatment fluid is applied in a pretreatment area, a printing means having at least one print head, by means of which the textile can be printed with a printed image in the pretreatment area, a movement means, by means of which the at least one pallet can be moved relative to the pretreatment means and the printing means, and a programmable control means, by means of which the printing means, the pretreatment means and/or the movement means can be controlled, wherein a detection means is provided, by means of which the textile can be detected, and the detection means is connected to the programmable control means, wherein, depending on the detected textile, the pretreatment area can be applied individually onto a partial area of the printing face of the textile.

2. Device according to claim 1, wherein the pretreatment means has at least one nozzle, by means of which the pretreatment fluid can be applied onto the textile, and the at least one nozzle can be controlled by means of the programmable control means.

3. Device according to claim 1, wherein the pretreatment means is designed over the entire width of the textile.

4. Device according to claim 1, wherein the pretreatment means has a plurality of nozzles, wherein the nozzles can be controlled individually by the programmable control means.

5. Device according to claim 1, wherein the pretreatment means is provided at an entrance area of a drying means which is in particular designed as a continuous dryer.

6. Device according to claim 1, wherein through the detection means a position of the textile on the pallet can be determined and through the programmable control means the pretreatment area can be applied depending on the position of the textile.

7. Device according to claim 1, wherein the programmable control means is designed to receive a clearly defined print job sent by a user and containing printing and image data, to identify the area to be printed on the textile by means of the detection means and to print a corresponding printed image onto the textile by means of the printing means.

8. Device according to claim 1, wherein a digital printing means having at least one printing nozzle prints the printed image onto the pretreated textile which is located on the pallet and the printing means is controlled by the programmable control means, wherein the printed image is printed individually onto the detected textile.

9. Method, in particular for a device according to claim 1, for pretreating and printing textile surfaces, in which a textile is pretreated by means of a pretreatment means prior to printing, wherein a pretreatment fluid is applied in a pretreatment area, a printing means, having at least one print head, prints a printed image onto the textile in the pretreatment area, and a programmable control means controls the printing means and/or the pretreatment means, wherein the textile is detected by a detection means and the programmable control means, which is connected to the detection means, determines the printing area on the detected textile and depending on the detected textile the pretreatment means applies the pretreatment area individually onto a textile area of the printing face of the textile.

10. Method according to claim 1, wherein the textile is provided with a marking which is designed to indicate an association of the textile with a print job clearly defined beforehand and containing printing and image data.

11. Method according to claim 10, wherein a detection means detects a marking on the textile and the programmable control means assigns the marking to a print job clearly defined beforehand and containing printing and image data.

12. Method according to claim 11, wherein by means of the detection means the programmable control means ascertains the position of the marking on the textile and transmits this information to the pretreatment means, the pretreatment means, based on the transmitted information and according to the print job clearly defined beforehand, applies the pretreatment area as intended.

13. Method according to claim 11, wherein the programmable control means receives a print job containing printing and image data that were sent by a user and by means of the printing means the textile is printed with a corresponding printed image.

14. Method according to claim 1, wherein the detection means has a readout means and/or a sensor means, by means of which the marking on the textile can be read out by the programmable control means.

* * * * *